US008371960B2

(12) United States Patent
Kimura et al.

(10) Patent No.: US 8,371,960 B2
(45) **Date of Patent: *Feb. 12, 2013**

(54) MULTI-PIECE SOLID GOLF BALL

(75) Inventors: Akira Kimura, Chichibu (JP); Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 590 days.

This patent is subject to a terminal disclaimer.

(21) Appl. No.: 12/613,111

(22) Filed: Nov. 5, 2009

(65) Prior Publication Data

US 2010/0048326 A1 Feb. 25, 2010

Related U.S. Application Data

(63) Continuation-in-part of application No. 11/926,160, filed on Oct. 29, 2007, now Pat. No. 7,637,826.

(51) Int. Cl.
*A63B 37/06* (2006.01)

(52) U.S. Cl. ..... 473/376

(58) Field of Classification Search ..... 473/376
See application file for complete search history.

(56) References Cited

U.S. PATENT DOCUMENTS

| | | | |
|---|---|---|---|
| 5,711,723 | A | 1/1998 | Hiroaka et al. |
| 5,772,531 | A | 6/1998 | Ohsumi et al. |
| 5,816,937 | A | 10/1998 | Shimosaka et al. |
| 6,045,460 | A | 4/2000 | Hayashi et al. |
| 6,123,630 | A | 9/2000 | Hayashi et al. |
| 6,194,505 | B1 | 2/2001 | Sone et al. |
| 6,231,461 | B1 | 5/2001 | Moriyama et al. |
| 6,248,027 | B1 | 6/2001 | Hayashi et al. |
| 6,416,425 | B1 | 7/2002 | Maruko et al. |
| 6,419,595 | B1 | 7/2002 | Maruko et al. |
| 6,468,169 | B1 | 10/2002 | Hayashi et al. |
| 6,527,652 | B1 | 3/2003 | Maruko et al. |
| 6,793,593 | B2 | 9/2004 | Binette et al. |
| 6,981,925 | B2 | 1/2006 | Shimizu et al. |
| 7,294,680 | B2 | 11/2007 | Sone et al. |
| 7,637,826 | B2 * | 12/2009 | Kimura et al. ..... 473/376 |
| 2004/0106474 | A1 | 6/2004 | Hayashi et al. |
| 2006/0128504 | A1 | 6/2006 | Watanabe et al. |

FOREIGN PATENT DOCUMENTS

| | | | |
|---|---|---|---|
| JP | 0833247 | A | 2/1996 |
| JP | 09248351 | A | 9/1997 |
| JP | 10127818 | A | 5/1998 |

(Continued)

*Primary Examiner* — Raeann Gorden
(74) *Attorney, Agent, or Firm* — Sughrue Mion, PLLC

(57) ABSTRACT

The present invention provides a multi-piece solid golf ball having a core, an envelope encasing the core, an intermediate layer encasing the envelope, and a cover which encases the intermediate layer and has formed on a surface thereof a plurality of dimples. The surface hardness of the core has a JIS-C hardness value of 40 to 95, the center hardness of the core has a JIS-C hardness value of 30 to 72, and the hardness difference therebetween is from 4 to 14. The envelope is composed of at least two layers. The core is formed primarily of a rubber material. The envelope, intermediate layer and cover are each formed primarily of the same or different resin materials. An optimized surface hardness relationship exists between the core, a Sphere I composed of the core encased by the envelope layers, a Sphere II composed of the core encased by the envelope layers and the intermediate layer, and a Sphere III composed of the core encased by the envelope layers, the intermediate layer and the cover. The golf ball has an outstanding flight performance and controllability which are acceptable to professionals and other skilled players, in addition to which it has an excellent durability to cracking under repeated impact and an excellent scuff resistance.

18 Claims, 1 Drawing Sheet

FOREIGN PATENT DOCUMENTS

| | | | |
|---|---|---|---|
| JP | 10127819 | A | 11/1998 |
| JP | 10295852 | A | 11/1998 |
| JP | 10328325 | A | 12/1998 |
| JP | 10328326 | A | 12/1998 |
| JP | 114916 | A | 1/1999 |
| JP | 1135633 | A | 2/1999 |
| JP | 11164912 | A | 6/1999 |
| JP | 2001017569 | A | 1/2001 |
| JP | 200137914 | A | 2/2001 |
| JP | 2004180822 | A | 7/2004 |

* cited by examiner

MULTI-PIECE SOLID GOLF BALL

CROSS-REFERENCE TO RELATED APPLICATION

This application is a continuation-in-part of copending application Ser. No. 11/926,160 filed on Oct. 29, 2007 now U.S. Pat. No. 7,637,826, the entire contents of which are hereby incorporated by reference.

BACKGROUND OF THE INVENTION

The present invention relates to a multi-piece solid golf ball composed of a core, an envelope, an intermediate layer and a cover that have been formed as successive layers. More specifically, the invention relates to a multi-piece solid golf ball which has a satisfactory flight performance and controllability when used by professionals and other skilled golfers, and also has an excellent durability to cracking under repeated impact and an excellent scuff resistance.

A variety of golf balls have hitherto been developed for professionals and other skilled golfers. Of these, multi-piece solid golf balls in which the hardness relationships among layers encasing the core, such as an intermediate layer and a cover layer, have been optimized are in wide use because they achieve both a superior distance in the high head speed range and good controllability on shots taken with an iron and on approach shots. Another important concern is the proper selection of thicknesses and hardnesses for the respective layers of the golf ball in order to optimize flight performance, the feel of the ball when played, and the spin rate of the ball after being struck with a club, particularly given the large influence of the spin rate on control of the ball. A further key concern in ball development, arising from the desire that golf balls also have durability under repeated impact and suppress burr formation on the ball surface (have improved scuff resistance) when repeatedly played with different types of clubs, is how best to protect the ball from external factors.

The three-piece solid golf balls having an outer cover layer formed primarily of a thermoplastic polyurethane that are disclosed in, for example, JP-A 2003-190330, JP-A 2004-049913, JP-A 2004-97802 and JP-A 2005-319287 were intended to meet such needs. However, these golf balls fail to achieve a sufficiently low spin rate when hit with a driver; professionals and other skilled golfers desire a ball which delivers an even longer distance.

Meanwhile, efforts to improve the flight and other performance characteristics of golf balls have led to the development of balls having a four-layer construction, i.e., a core enclosed by three intermediate and cover layers, that allows the ball construction to be varied among the several layers at the interior. Such golf balls have been disclosed in, for example, JP-A 9-248351, JP-A 10-127818, JP-A 10-127819, JP-A 10-295852, JP-A 10-328325, JP-A 10-328326, JP-A 10-328327, JP-A 10-328328, JP-A 11-4916 and JP-A 2004-180822.

Yet, as golf balls for the skilled golfer, such balls have a poor balance of distance and controllability or fall short in terms of achieving a lower spin rate on shots with a driver, thus limiting the degree to which the total distance can be increased.

Also, the golf balls disclosed in JP-A 2001-17569, U.S. Pat. No. 6,416,425 and JP-A 2001-37914 (and the corresponding U.S. Pat. No. 6,527,652) are five-piece golf balls composed of a core encased by a first to a fourth cover layer, in which the thicknesses and hardnesses of the respective layers have been optimized. However, these balls have a poor controllability for use by skilled golfers.

The golf ball disclosed in JP-A 8-332247 is a three-piece solid golf ball in which a hard intermediate layer has not been formed. The spin rate-lowering effect is inadequate, resulting in a poor distance. In the golf ball disclosed in JP-A 2000-245873, because the intermediate layer and the cover layer have the same hardness, the spin rate-lowering effect is inadequate, as a result of which the distance is poor.

SUMMARY OF THE INVENTION

It is therefore an object of the present invention to provide a multi-piece solid golf ball which has a satisfactory flight performance and controllability when used by professionals and other skilled golfers, can achieve an increased distance even on full shots with an iron, and has an excellent durability to cracking on repeated impact and an excellent scuff resistance.

The present invention provides, as the basic construction in a golf ball design, a multilayer structure composed of a core enclosed by four or more layers which include, in order: two or more envelope layers, one or more intermediate layer and a cover. The core is formed of a rubber material, and the envelope layers, intermediate layer and cover are each formed primarily of the same or different resin materials. In the invention, by adjusting the surface hardness of the core, the center hardness of the core and the hardness difference therebetween, and by optimizing the hardnesses of the respective surfaces of the core and Spheres I, II and III (where "Sphere I" is the sphere composed of the core encased by the envelope layers; "Sphere II" is the sphere composed of the core encased by the envelope layers and the intermediate layer; and "Sphere III" is the sphere composed of the core encased by the envelope layers, intermediate layer and cover), it was possible through the synergistic effects of these hardness relationships and layer thickness relationships to resolve the above-described problems encountered in the prior art. That is, the golf ball of the invention, when used by professionals and other skilled golfers, provides a fully satisfactory flight performance and controllability. In particular, even on full shots with an iron, a longer distance can be achieved and the straightness of the ball's trajectory can be increased. The ball also has an excellent durability to cracking on repeated impact and an excellent scuff resistance. Such a combination of effects was entirely unanticipated. The inventor, having thus found that the technical challenges recited above can be overcome by the foregoing arrangement, ultimately arrived at the present invention.

Accordingly, the invention provides the following multi-piece solid golf balls.

[1] A multi-piece solid golf ball comprising a core, an envelope encasing the core, an intermediate layer encasing the envelope, and a cover which encases the intermediate layer and has formed on a surface thereof a plurality of dimples, wherein the surface hardness of the core has a JIS-C hardness value of 40 to 95, the center hardness of the core has a JIS-C hardness value of 30 to 72, and the hardness difference therebetween is from 4 to 20; the envelope is composed of at least two layers; the core is formed primarily of a rubber material; the envelope, intermediate layer and cover are each formed primarily of the same or different resin materials; and the core, a Sphere I composed of the core encased by the envelope layers, a Sphere II composed of the core encased by the envelope layers and the intermediate layer, and a Sphere III composed of the core encased by the envelope layers, the intermediate layer and the cover have JIS-C surface hardness relationships therebetween which satisfy the following condition:

core surface hardness≦Sphere I surface hardness<Sphere II surface hardness>Sphere III surface hardness.

[2] The multi-piece solid golf ball of [1], wherein each envelope layer has a thickness of at least 1 mm but not more than 5 mm.

[3] The multi-piece solid golf ball of [1], wherein the core has a deflection (P) when compressed under a final load of 1,275 N (130 kgf) from an initial load of 98 N (10 kgf) and the ball as a whole has a deflection (Q) when compressed under a final load of 1,275 N (130 kgf) from an initial load of 98 N (10 kgf) which satisfy the condition $$1.7 \leqq (P)/(Q) \leqq 4.7.$$

[4] The multi-piece solid golf ball of [1], wherein the resin material of at least one layer from among the envelope layers and the intermediate layer comprises, in admixture, an ionomer resin component of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50.

[5] The multi-piece solid golf ball of [1], wherein the resin material of at least one layer from among the envelope layers and the intermediate layer is a mixture comprising: 100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) 5 to 80 parts by weight of a fatty acid and/or fatty acid derivative having a molecular weight of 228 to 1500; and (d) 0.1 to 17 parts by weight of a basic inorganic metal compound capable of neutralizing un-neutralized acid groups in the base resin and component (c).

[6] The multi-piece solid golf ball of [1], wherein the cover is formed by injection molding a single resin blend composed primarily of (A) a thermoplastic polyurethane and (B) a polyisocyanate compound, which resin blend contains a polyisocyanate compound in at least some portion of which all the isocyanate groups remain in an unreacted state.

[7] The multi-piece solid golf ball of [1], wherein the envelope layers and the intermediate layer have a combined thickness which is 6.0 to 13 times thicker than the cover.

[8] The multi-piece solid golf ball of [1], wherein the combined thickness of the envelope layers and the intermediate layer is 3.0 to 14.0 mm.

[9] The multi-piece solid golf ball of [1], wherein an organosulfur compound is included in the rubber material constituting the core by an amount of 0.05 to 5 parts by weight per 100 parts by weight of the base rubber.

[10] The multi-piece solid golf ball of [1], wherein each of the envelope layers has a material hardness of 20 to 70 expressed as the Durometer D hardness, and the individual envelope layers are arranged so that successive envelope layers in the outward direction are of the same or greater hardness, within the above-indicated hardness range.

[11] The multi-piece solid golf ball of [10], wherein the envelope layer directly in contact with the intermediate layer has a material hardness expressed as the Durometer D hardness of 56 to 70.

[12] The multi-piece solid golf ball of [1], wherein the surface of the Sphere I has a JIS-C hardness of 47 to 105.

[13] The multi-piece solid golf ball of [1], wherein the surface of the envelope is lower than the surface of the intermediate layer by a difference of 1 to 20 in JIS-C hardness units.

[14] The multi-piece solid golf ball of [1], wherein the intermediate layer has a material hardness of 50 to 70 expressed as the Durometer D hardness.

[15] The multi-piece solid golf ball of [1], wherein the Sphere II surface hardness is higher than Sphere III surface hardness by a difference of 3 to 20 in JIS-C hardness units.

[16] The multi-piece solid golf ball of [1], wherein the number of the dimples is 280 to 360, the dimple coverage on the spherical surface of the golf ball expressed as a ratio (SR) is 60 to 90%, the value $V_0$ obtained by dividing the spatial volume of each dimple below the flat plane circumscribed by the edge of that dimple by the volume of a cylinder whose base is the flat plane and whose height is the maximum depth of the dimple from the base is 0.35 to 0.80, and the VR value, which is the sum of the volumes of the individual dimples formed below the flat plane circumscribed by the edge of the respective dimple, as a percentage of the volume of the ball sphere were it to have no dimples thereon, is 0.6 to 1.0%.

[17] The multi-piece solid golf ball of [1], wherein the deflection of the core when compressed under a final load of 1,275 N (130 kgf) from an initial load of 98 N (10 kgf) is from 5.7 to 10.0 mm.

[18] The multi-piece solid golf ball of [1], wherein the polybutadiene synthesized with a rare-earth catalyst or a Group VIII metal compound catalyst is used as the base rubber of the rubber material.

BRIEF DESCRIPTION OF THE DIAGRAMS

DETAILED DESCRIPTION OF THE INVENTION

Figure 1:
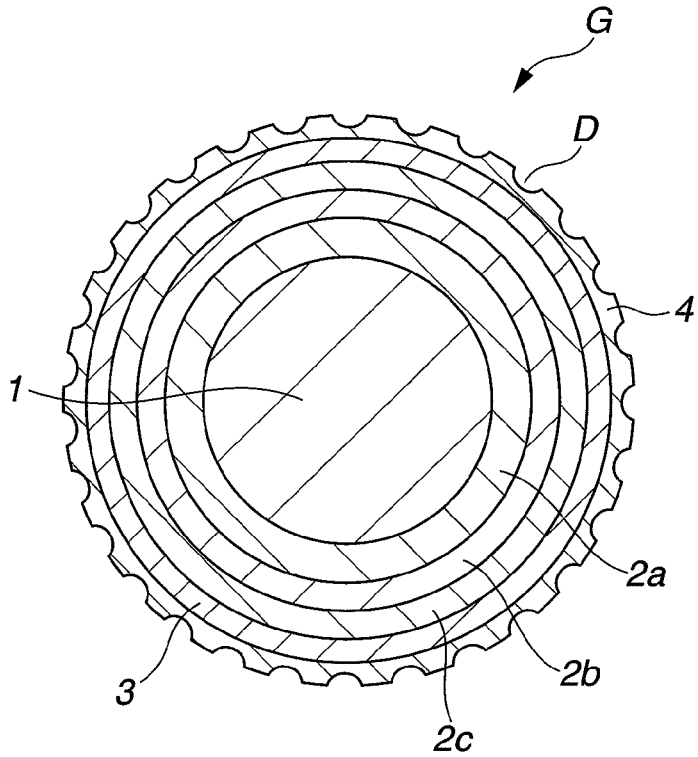
FIG. 1 is a schematic sectional view showing a multi-piece solid golf ball (with three envelope layers) according to the invention.

The invention is described more fully below. The multi-piece solid golf ball of the present invention is formed of a core encased by four or more covering layers, including two or more envelope layers, one or more intermediate layer and a cover. For example, the golf ball G shown in FIG. 1 has a core 1, a three-layer (inner/intermediate/outer) envelope 2 which encases the core, an intermediate layer 3 which encases the envelope, and a cover 4 which encases the intermediate layer. The envelope 2 is formed of three distinct layers (2*a*, 2*b*, 2*c*). The cover 4 typically has a large number of dimples D formed on the surface thereof. The core 1, the intermediate layer 3 and the cover 4 are not limited to single layers, and may each be formed of a plurality of two more layers.

In this invention, the core diameter, while not subject to any particular limitation, is preferably at least 15 mm, more preferably at least 18 mm, and even more preferably at least 22 mm, but preferably not more than 35 mm, more preferably not more than 30 mm, and even more preferably not more than 28 mm. At a core diameter outside this range, the ball may have a lower initial velocity and the spin rate-lowering effect after the ball is hit may be inadequate, as a result of which an increased distance may not be achieved.

The surface hardness of the core has a JIS-C hardness value of at least 40, preferably at least 45, and more preferably at least 50, but not more than 95, preferably not more than 90, and more preferably not more than 85. The center hardness of the core has a JIS-C hardness value of at least 30, preferably at least 35, and more preferably at least 42, but not more than 72, preferably not more than 68, and more preferably not more than 63. Below the above ranges, the rebound characteristics of the core may be inadequate, as a result of which an increased distance may not be achieved, and the durability to cracking on repeated impact may worsen. Conversely, at core hardness values higher than the above ranges, the ball may have an excessively hard feel on full shots and the spin rate may be too high, as a result of which an increased distance may not be achieved.

In the present invention, the core hardness may increase from the center to the surface of the core, the hardness difference therebetween in JIS-C units being at least 4, and preferably at least 7, but not more than 20, preferably not more than 16. If this difference is too small, the spin rate-lowering effect on shots taken with a W#1 may be inadequate, which may prevent the desired distance from being achieved. On the other hand, if the difference is too large, the initial velocity on impact may decrease, as a result of which the desired distance may not be achieved, and the durability to cracking on repeated impact may worsen.

The JIS-C hardness at the core surface is set so as to be either the same as or less than the surface hardness of a sphere composed of the core encased by the envelope layer. If this condition is not met, the spin rate-lowering effect may be inadequate, as a result of which the desired distance may not be achieved on shots with an iron.

The deflection when the core is subjected to compressive loading, i.e., the deflection of the core when compressed under a final load of 1,275 N (130 kgf) from an initial load of 98 N (10 kgf), while not subject to any particular limitation, is preferably at least 3.6 mm, more preferably at least 4.0 mm, and even more preferably at least 4.5 mm, but preferably not more than 12.0 mm, more preferably not more than 10.0 mm, and even more preferably not more than 9.0 mm. If this value is too high, the core may lack sufficient rebound, which may result in a less than adequate distance, or the durability of the ball to cracking on repeated impact may worsen. On the other hand, if this value is too low, the ball may have an excessively hard feel on full shots, and the spin rate may be too high, as a result of which an increased distance may not be achieved.

A material composed primarily of rubber may be used to form the core having the above-described surface hardness and deflection. For example, the core may be formed of a rubber composition containing, in addition to the rubber component, a co-crosslinking agent, an organic peroxide, an inert filler, an organosulfur compound and the like. It is preferable to use polybutadiene as the base rubber of this rubber composition.

It is desirable for the polybutadiene serving as the rubber component to have a cis-1,4-bond content on the polymer chain of preferably at least 60 wt %, more preferably at least 80 wt %, even more preferably at least 90 wt %, and most preferably at least 95 wt %. Too low a cis-1,4-bond content among the bonds on the molecule may result in a lower resilience.

Also, the polybutadiene has a 1,2-vinyl bond content on the polymer chain of preferably not more than 2%, more preferably not more than 1.7%, and even more preferably not more than 1.5%. Too high a 1,2-vinyl bond content may result in a lower resilience.

To obtain a molded and vulcanized rubber composition of good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthanide series rare-earth compound catalyst to account for at least 10 wt %, preferably at least 20 wt %, and more preferably at least 40 wt %, of the rubber components.

Rubber components other than the above-described polybutadiene may be included in the base rubber insofar as the objects of the invention are attainable. Illustrative examples of rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The unsaturated carboxylic acid and/or metal salt thereof is included in an amount, per 100 parts by weight of the base rubber, of preferably at least 10 parts by weight, more preferably at least 15 parts by weight, and even more preferably at least 20 parts by weight, but preferably not more than 60 parts by weight, more preferably not more than 50 parts by weight, even more preferably not more than 45 parts by weight, and most preferably not more than 40 parts by weight. Too much may make the core too hard, giving the ball an unpleasant feel on impact, whereas too little may lower the rebound.

The organic peroxide may be a commercially available product, suitable examples of which include Percumyl D (produced by NOF Corporation), Perhexa C-40 and Perhexa 3M (both produced by NOF Corporation), and Luperco 231XL (Atochem Co.). These may be used singly or as a combination of two or more thereof.

The amount of organic peroxide included per 100 parts by weight of the base rubber is preferably at least 0.1 part by weight, more preferably at least 0.3 part by weight, even more preferably at least 0.5 part by weight, and most preferably at least 0.7 part by weight, but preferably not more than 5 parts by weight, more preferably not more than 4 parts by weight, even more preferably not more than 3 parts by weight, and most preferably not more than 2 parts by weight. Too much or too little organic peroxide may make it impossible to achieve a ball having a good feel, durability and rebound.

Examples of suitable inert fillers include zinc oxide, barium sulfate and calcium carbonate. These may be used singly or as a combination of two or more thereof.

The amount of inert filler included per 100 parts by weight of the base rubber is preferably at least 1 part by weight, and more preferably at least 5 parts by weight, but preferably not more than 50 parts by weight, more preferably not more than 40 parts by weight, and even more preferably not more than 30 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30 (both available from Ouchi Shinko Chemical Industry Co., Ltd.), and Yoshinox 425 (available from Yoshitomi Pharmaceutical Industries, Ltd.). These may be used singly or as a combination of two or more thereof.

The amount of antioxidant included per 100 parts by weight of the base rubber is preferably 0 or more part by weight, more preferably at least 0.05 part by weight, and even more preferably at least 0.1 part by weight, but preferably not more than 3 parts by weight, more preferably not more than 2 parts by weight, even more preferably not more than 1 part by weight, and most preferably not more than 0.5 part by weight. Too much or too little antioxidant may make it impossible to achieve a good rebound and durability.

To enhance the rebound of the golf ball and increase its initial velocity, it is preferable to include within the core an organosulfur compound.

No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. The zinc salt of pentachlorothiophenol is especially preferred.

It is recommended that the amount of the organosulfur compound included per 100 parts by weight of the base rubber be preferably at least 0.05 part by weight, more preferably at least 0.1 part by weight, and even more preferably at least 0.2 part by weight, but preferably not more than 5 parts by weight, more preferably not more than 3 parts by weight, and even more preferably not more than 2.5 parts by weight. If too much organosulfur compound is included, further improvement in the rebound (especially on impact with a W#1) is unlikely to be achieved and the core may become too soft, possibly resulting in a poor feel.

Next, the envelope is described.

The envelope directly encases the above-described core. In the present invention, this envelope is formed as two or more distinct layers.

Each of the envelope layers has a material hardness, expressed as the Durometer D hardness (measured with a type D durometer in accordance with ASTM D 2240), which, while not subject to any particular limitation, is preferably at least 20, more preferably at least 30, and even more preferably at least 35, but preferably not more than 70, more preferably not more than 65, and even more preferably not more than 62. Moreover, it is desirable for the individual envelope layers to be arranged so that successive envelope layers in the outward direction are of the same or greater hardness, within the above-indicated hardness range.

The sphere composed of the core encased by the envelope layers (which sphere is referred to below as "Sphere I") has a surface hardness which is equal to or greater than the surface hardness of the core, and which is softer than the JIS-C surface hardness of the intermediate layer. If the surface hardness of Sphere I is too much softer than the core surface, the ball will be too receptive to spin on full shots, and therefore will not travel as far as desired. On the other hand, if the surface of Sphere I is harder than the surface of the sphere composed of the core encased by the envelope layers and the intermediate layer (which sphere is referred to below as "Sphere II"), the ball will have a poor durability to cracking under repeated impact and will have too hard a feel on impact.

Here, in the phrase "Sphere I composed of the core encased by the envelope layers," the envelope layers encasing the core signify the overall envelope. Thus, if the envelope is formed of three layers, Sphere I refers to the sphere composed of the core encased by all three of these envelope layers.

Each of the envelope layers has a thickness which, while not subject to any particular limitation, is preferably at least 1.0 mm, more preferably at least 1.4 mm, and even more preferably at least 1.8 mm, but preferably not more than 5.0 mm, more preferably not more than 4.3 mm, and even more preferably not more than 3.5 mm. Outside of this range, the spin rate-lowering effect on shots taken with a driver (W#1) may be inadequate, as a result of which an increased distance may not be achieved. Moreover, it is desirable for the overall envelope to be thicker than the intermediate layer and the cover. In the present invention, if the envelope is thinner than the intermediate layer and the cover, the spin rate-lowering effect may be inadequate, as a result of which the desired distance may not be achieved.

The surface of the envelope, i.e., the surface of the sphere composed of the core encased by the envelope layers (Sphere I), has a JIS-C hardness which, while not subject to any particular limitation, is preferably at least 47, more preferably at least 60, and even more preferably at least 67, but preferably not more than 105, more preferably not more than 100, and even more preferably not more than 97. At a surface hardness lower than this range, the ball may have too much spin receptivity on full shots, as a result of which an increased distance may not be achieved. On the other hand, if the surface hardness is higher than the above range, the durability of the ball to cracking under repeated impact may worsen and the ball may have too hard a feel when played. It is essential for the surface of the envelope to be softer than the surface of the intermediate layer. While no particular limitation is imposed on the degree to which it is softer, the difference in JIS-C hardness units is preferably at least 1, more preferably at least 1.5, and even more preferably at least 2, but preferably not more than 20, more preferably not more than 18, and even more preferably not more than 16. Outside of this range, if the surface of the envelope is too much softer than the surface of the intermediate layer, the rebound of the ball may decrease or the spin rate may become excessive, as a result of which an increased distance may not be achieved.

The envelope is composed of a plurality of two or more layers. Each layer making up the overall envelope preferably has a surface hardness (JIS-C hardness) which is equal to or greater than the surface hardness of the layer immediately below it.

As noted above, the envelope in the invention is composed of two or more layers which may be made primarily of the same resin material or different resin materials. The resin materials of the respective envelope layers, while not subject to any particular limitation, preferably include as an essential component a base resin composed of, in admixture, specific amounts of (a) an olefin-unsaturated carboxylic acid random copolymer and/or a metal ion neutralization product of an olefin-unsaturated carboxylic acid random copolymer and (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer. That is, in the present invention, by using the material described below as the preferred material in the envelope layers, the spin rate on shots with a W#1 can be lowered, enabling a longer distance to be achieved.

The olefin in the above base resin, whether in component (a) or component (b), has a number of carbons which is preferably at least 2 but preferably not more than 8, and more preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid random copolymer of component (a) and the olefin-unsaturated carboxylic acid-unsaturated carboxylic acid ester random terpolymer of component (b) (the copolymers in components (a) and (b) are referred to collectively below as "random copolymers") can each be obtained by preparing the above-mentioned materials and carrying out random copolymerization by a known method.

It is recommended that the above random copolymers have unsaturated carboxylic acid contents (acid contents) that are controlled. Here, it is recommended that the content of unsaturated carboxylic acid present in the random copolymer serving as component (a) be preferably at least 4 wt %, more preferably at least 6 wt %, even more preferably at least 8 wt %, and most preferably at least 10 wt %, but preferably not more than 30 wt %, more preferably not more than 20 wt %, even more preferably not more than 18 wt %, and most preferably not more than 15 wt %.

Similarly, it is recommended that the content of unsaturated carboxylic acid present in the random copolymer serving as component (b) be preferably at least 4 wt %, more preferably at least 6 wt %, and even more preferably at least 8 wt %, but preferably not more than 15 wt %, more preferably not more than 12 wt %, and even more preferably not more than 10 wt %. If the acid content of the random copolymer is too low, the resilience may decrease, whereas if it is too high, the processability of the envelope layer-forming resin material may decrease.

The metal ion neutralization product of the olefin-unsaturated carboxylic acid random copolymer of component (a) and the metal ion neutralization product of the olefin-unsaturated carboxylic acid-unsaturated carboxylic acid ester random terpolymer of component (b) (the metal ion neutralization products of the copolymers in components (a) and (b) are referred to collectively below as "metal ion neutralization products of the random copolymers") can be obtained by neutralizing some of the acid groups on the random copolymers with metal ions.

Illustrative examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. To improve resilience, the use of $Na^+$ is even more preferred.

The above metal ion neutralization products of the random copolymers may be obtained by neutralizing the random copolymers with the foregoing metal ions. For example, use may be made of a method in which neutralization is carried out with a compound such as a formate, acetate, nitrate, carbonate, bicarbonate, oxide, hydroxide or alkoxide of the above-mentioned metal ions. No particular limitation is imposed on the degree of neutralization of the random copolymer by these metal ions.

Sodium ion-neutralized ionomer resins may be suitably used as the above metal ion neutralization products of the random copolymers to increase the melt flow rate of the material. In this way, adjustment of the material to the subsequently described optimal melt flow rate is easy, enabling the moldability to be improved.

Commercially available products may be used as the base resins of above components (a) and (b). Illustrative examples of the random copolymer in component (a) include Nucrel 1560, Nucrel 1214 and Nucrel 1035 (all products of DuPont-Mitsui Polychemicals Co., Ltd.), and Escor 5200, Escor 5100 and Escor 5000 (all products of ExxonMobil Chemical). Illustrative examples of the random copolymer in component (b) include Nucrel AN4311 and Nucrel AN4318 (both products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical).

Sodium-neutralized ionomer resins that are suitable as the metal ion neutralization product of the random copolymer include Himilan 1605, Himilan 1601 and Himilan 1555.

When preparing the above-described base resin, component (a) and component (b) are admixed in a weight ratio of between 100:0 and 0:100, preferably between 100:0 and 25:75, more preferably between 100:0 and 50:50, even more preferably between 100:0 and 75:25, and most preferably 100:0. If too little component (a) is included, the molded material obtained therefrom may have a decreased resilience.

In addition, the processability of the base resin can be further improved by also adjusting the ratio in which the random copolymers and the metal ion neutralization products of the random copolymers are admixed when preparing the base resin as described above. It is recommended that the weight ratio of the random copolymers to the metal ion neutralization products of the random copolymers be between 0:100 and 60:40, preferably between 0:100 and 40:60, more preferably between 0:100 and 20:80, and even more preferably 0:100. The addition of too much random copolymer may lower the processability during mixing.

Component (e) described below may be added to the base resin. Component (e) is a non-ionomeric thermoplastic elastomer. The purpose of this component is to further improve the feel of the ball on impact and the rebound. Examples include olefin elastomers, styrene elastomers, polyester elastomers, urethane elastomers and polyamide elastomers. To further increase the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

It is recommended that component (e) be included in an amount, per 100 parts by weight of the base resin of the invention, of preferably at least 0 part by weight, more preferably at least 5 parts by weight, even more preferably at least 10 parts by weight, and most preferably at least 20 parts by weight, but preferably not more than 100 parts by weight, more preferably not more than 60 parts by weight, even more preferably not more than 50 parts by weight, and most preferably not more than 40 parts by weight. Too much component (e) will lower the compatibility of the mixture, possibly resulting in a substantial decline in the durability of the golf ball.

Next, component (c) described below may be added to the base resin. Component (c) is a fatty acid or fatty acid derivative having a molecular weight of at least 228 but not more than 1500. Compared with the base resin, this component has a very low molecular weight and, by suitably adjusting the melt viscosity of the mixture, helps in particular to improve the flow properties. Component (c) includes a relatively high content of acid groups (or derivatives thereof), and is capable of suppressing an excessive loss in resilience.

The fatty acid or fatty acid derivative of component (c) has a molecular weight of at least 228, preferably at least 256, more preferably at least 280, and even more preferably at least 300, but not more than 1500, preferably not more than 1000, even more preferably not more than 600, and most preferably not more than 500. If the molecular weight is too low, the heat resistance cannot be improved. On the other hand, if the molecular weight is too high, the flow properties cannot be improved.

The fatty acid or fatty acid derivative of component (c) may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be preferably at least 18, more preferably at least 20, even more preferably at least 22, and most preferably at least 24, but preferably not more than 80, more preferably not more than 60, even more preferably not more than 40, and most preferably not more than 30. Too few carbons may make it impossible to improve the heat resistance and may also make the acid group content so high as to diminish the flow-improving effect due to interactions with acid groups present in the base resin. On the other hand, too many carbons increases the molecular weight, which may keep a distinct flow-improving effect from appearing.

Specific examples of the fatty acid of component (c) include myristic acid, palmitic acid, stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

The fatty acid derivative of component (c) is exemplified by metallic soaps in which the proton on the acid group of the fatty acid has been replaced with a metal ion. Examples of the metal ion include $Na^{+}$, $Li^{+}$, $Ca^{++}$, $Mg^{++}$, $Zn^{++}$, $Mn^{++}$, $Al^{+++}$, $Ni^{++}$, $Fe^{++}$, $Fe^{++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (d) may be added as a basic inorganic metal compound capable of neutralizing acid groups in the base resin and in component (c). If component (d) is not included, when a metal soap-modified ionomer resin (e.g., the metal soap-modified ionomer resins cited in the above-mentioned patent publications) is used alone, the metallic soap and un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, if the fatty acid thus generated deposits on the surface of the molded material, it may substantially lower paint film adhesion and may have other undesirable effects such as lowering the resilience of the resulting molded material.

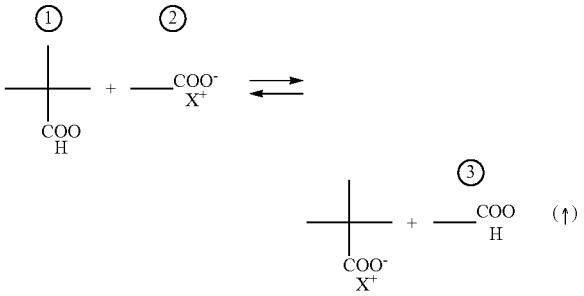

(1) un-neutralized acid group present on the ionomer resign
(2) metallic soap
(3) fatty acid
X: metal cation Accordingly, to solve this problem, the envelope layer-forming resin material includes also, as an essential component, a basic inorganic metal compound (d) which neutralizes the acid groups present in the base resin and component (c), in this way improving the resilience of the molded material.

That is, by including component (d) as an essential ingredient in the material, not only are the acid groups in the base resin and component (c) neutralized, through synergistic effects from the optimal addition of each of these components it is possible as well to increase the thermal stability of the mixture and give it a good moldability, and also to enhance the resilience.

Here, it is recommended that the basic inorganic metal compound used as component (d) be a compound which has a high reactivity with the base resin and contains no organic acids in the reaction by-products, thus enabling the degree of neutralization of the mixture to be increased without a loss of thermal stability.

Illustrative examples of the metal ion in the basic inorganic metal compound serving as component (d) include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are more preferred. Calcium hydroxide is especially preferred.

Because the above-described resin material is arrived at by blending specific respective amounts of components (c) and (d) with the resin component, i.e., the base resin containing specific respective amounts of components (a) and (b) in combination with optional component (e), this material has excellent thermal stability, flow properties and moldability, and can impart the molded material with a markedly improved resilience.

Components (c) and (d) are included in respective amounts, per 100 parts by weight of the resin component suitably formulated from components (a), (b) and (e), of at least 5 parts by weight, preferably at least 10 parts by weight, more preferably at least 15 parts by weight, and even more preferably at least 18 parts by weight, but not more than 80 parts by weight, preferably not more than 40 parts by weight, more preferably not more than 25 parts by weight, and even more preferably not more than 22 parts by weight, of component (c); and at least 0.1 part by weight, preferably at least 0.5 part by weight, more preferably at least 1 part by weight, and even more preferably at least 2 parts by weight, but not more than 17 parts by weight, preferably not more than 15 parts by weight, more preferably not more than 13 parts by weight, and even more preferably not more than 10 parts by weight, of component (d). Too little component (c) lowers the melt viscosity, resulting in inferior processability, whereas too much lowers the durability. Too little component (d) fails to improve thermal stability and resilience, whereas too much instead lowers the heat resistance of the golf ball-forming material due to the presence of excess basic inorganic metal compound.

In the above-described resin material formulated from the respective above-indicated amounts of the resin component and components (c) and (d), it is recommended that preferably at least 50 mol %, more preferably at least 60 mol %, even more preferably at least 70 mol %, and most preferably at least 80 mol %, of the acid groups be neutralized. Such a high degree of neutralization makes it possible to more reliably suppress the exchange reactions that cause trouble when only a base resin and a fatty acid or fatty acid derivative are used as in the above-cited prior art, thus preventing the generation of fatty acid. As a result, there is obtained a resin material of substantially improved thermal stability and good processability which can provide molded products of much better resilience than prior-art ionomer resins.

"Degree of neutralization," as used above, refers to the degree of neutralization of acid groups present within the mixture of the base resin and the fatty acid or fatty acid derivative serving as component (c), and differs from the degree of neutralization of the ionomer resin itself when an ionomer resin is used as the metal ion neutralization product of a random copolymer in the base resin. A mixture according to the invention having a certain degree of neutralization, when compared with an ionomer resin alone having the same degree of neutralization, contains a very large number of metal ions. This large number of metal ions increases the density of ionic crosslinks which contribute to improved resilience, making it possible to confer the molded product with excellent resilience.

To more reliably achieve a material having both a high degree of neutralization and good flow properties, it is recommended that the acid groups in the above-described mixture be neutralized with transition metal ions and with alkali metal and/or alkaline earth metal ions. Although neutralization with transition metal ions results in a weaker ionic cohesion than neutralization with alkali metal and alkaline earth metal ions, by using these different types of ions together to neutralize acid groups in the mixture, a substantial improvement can be made in the flow properties.

It is recommended that the molar ratio between the transition metal ions and the alkali metal and/or alkaline earth metal ions be in a range of typically 10:90 to 90:10, preferably 20:80 to 80:20, more preferably 30:70 to 70:30, and even more preferably 40:60 to 60:40. Too low a molar ratio of transition metal ions may fail to provide a sufficient flow-improving effect. On the other hand, a transition metal ion molar ratio which is too high may lower the resilience.

Examples of the metal ions include, but are not limited to, zinc ions as the transition metal ions and at least one type of ion selected from among sodium, lithium and magnesium ions as the alkali metal or alkaline earth metal ions.

A known method may be used to obtain a mixture in which the desired amount of acid groups have been neutralized with transition metal ions and alkali metal or alkaline earth metal ions. Specific examples of methods of neutralization with transition metal ions, particularly zinc ions, include a method which uses a zinc soap as the fatty acid derivative, a method which uses a zinc ion neutralization product (e.g., a zinc ion-neutralized ionomer resin) when formulating components (a) and (b) as the base resin, and a method which uses a zinc compound such as zinc oxide as the basic inorganic metal compound of component (d).

The resin material should preferably have a melt flow rate adjusted to ensure flow properties that are particularly suitable for injection molding, and thus improve moldability. Specifically, it is recommended that the melt flow rate (MFR), as measured according to JIS-K7210 at a temperature of 190° C. and under a load of 21.18 N (2.16 kgf), be set to preferably at least 0.6 dg/min, more preferably at least 0.7 dg/min, even more preferably at least 0.8 dg/min, and most preferably at least 2 dg/min, but preferably not more than 20 dg/min, more preferably not more than 10 dg/min, even more preferably not more than 5 dg/min, and most preferably not more than 3 dg/min. Too high or low a melt flow rate may result in a substantial decline in processability.

Illustrative examples of the envelope layer material include those having the trade names HPF 1000, HPF 2000, HPF AD1027, HPF AD1035 and HPF AD1040, as well as the experimental material HPF SEP1264-3, all produced by E.I. DuPont de Nemours & Co.

Next, the intermediate layer is described.

The intermediate layer is the layer which directly encases the above-described envelope, and is itself composed of one or more layer.

The material from which the intermediate layer is formed has a hardness, expressed as the Durometer D hardness (measured with a type D durometer in accordance with ASTM D 2240), which, while not subject to any particular limitation, is preferably at least 50, more preferably at least 55, and even more preferably at least 60, but preferably not more than 70, more preferably not more than 66, and even more preferably not more than 63. If the intermediate layer material is softer than the above range, the ball may have too much spin receptivity on full shots, as a result of which an increased distance may not be attained. On the other hand, if this material is harder than the above range, the durability of the ball to cracking on repeated impact may worsen and the ball may have too hard a feel when played with a putter or on short approach shots. The intermediate layer has a thickness which, while not subject to any particular limitation, is preferably at least 0.7 mm, more preferably at least 0.9 mm, and even more preferably at least 1.1 mm, but preferably not more than 2.0 mm, more preferably not more than 1.7 mm, and even more preferably not more than 1.4 mm. Outside of this range, the spin rate-lowering effect on shots with a driver (W#1) may be inadequate, as a result of which an increased distance may not be achieved. Moreover, a thickness lower than the above range may worsen the durability to cracking on repeated impact.

The intermediate layer is formed primarily of a resin material which may be the same as or different from the above-described envelope layer material. Alternatively, the intermediate layer may be formed of a known ionomer resin. Specific examples include sodium-neutralized ionomer resins available under the trade name designations Himilan 1605, Himilan 1601 and Surlyn 8120, and zinc-neutralized ionomer resins such as Himilan 1557 and Himilan 1706. These may be used singly or as a combination of two or more thereof.

An embodiment in which the intermediate layer material is composed primarily of, in admixture, both a zinc-neutralized ionomer resin and a sodium-neutralized ionomer resin is especially preferable for attaining the objects of the invention. The mixing ratio, expressed as zinc-neutralized resin/sodium-neutralized resin (weight ratio), is generally from 25/75 to 75/25, preferably from 35/65 to 65/35, and more preferably from 45/55 to 55/45.

Outside of this range, the ball rebound may be too low, as a result of which the desired distance may not be achieved, the durability to repeated impact at normal temperature may worsen, and the durability to cracking at low temperatures (below 0° C.) may worsen.

The surface of the intermediate layer, i.e., the surface of a sphere composed of the core enclosed by the envelope layers and the intermediate layer (Sphere II), has a JIS-C hardness which, while not subject to any particular limitation, is preferably at least 48, more preferably at least 62, and even more preferably at least 69, but preferably not more than 103, more preferably not more than 101, and even more preferably not more than 100. If the surface of the intermediate layer is softer than the above range, the ball may have too much spin receptivity on full shots, as a result of which an increased distance may not be achieved. On the other hand, if it is harder than the above range, the durability of the ball to cracking on repeated impact may worsen and the ball may have too hard a feel when played with a putter or on short approach shots.

Sphere II is formed so as to have a surface hardness which is preferably up to 60, more preferably up to 55, and even more preferably up to 50, JIS-C hardness units higher than the surface hardness of the envelope.

To increase adhesion between the intermediate layer material and the polyurethane used in the subsequently described cover, it is desirable to abrade the surface of the intermediate layer. In addition, it is preferable to apply a primer (adhesive) to the surface of the intermediate layer following such abrasion or to add an adhesion reinforcing agent to the intermediate layer material. Examples of adhesion reinforcing agents that may be incorporated in the material include organic compounds such as 1,3-butanediol and trimethylolpropane, and oligomers such as polyethylene glycol and polyhydroxy polyolefin oligomers. The use of trimethylolpropane or a polyhydroxy polyolefin oligomer is especially preferred. Examples of commercially available products include trimethylolpropane produced by Mitsubishi Gas Chemical Co., Ltd. and polyhydroxy polyolefin oligomers produced by Mitsubishi Chemical Corporation (under the trade name designation Polytail H; number of main-chain carbons, 150 to 200; with hydroxyl groups at the ends).

Next, the cover is described.

The cover is the outer layer of the ball which directly encases the above-described intermediate layer, and may be composed of one or more layer.

The cover material has a hardness, expressed as the Durometer D hardness, which, while not subject to any particular limitation, is preferably at least 40, more preferably at least 43, and even more preferably at least 46, but preferably not more than 60, more preferably not more than 57, and even more preferably not more than 54. At a hardness below this range, the ball tends to take on too much spin on full shots, as a result of which an increased distance may not be achieved. On the other hand, at a hardness above this range, on approach shots, the ball lacks spin receptivity and thus may have an inadequate controllability even when played by a professional or other skilled golfer.

The thickness of the cover, while not subject to any particular limitation, is preferably at least 0.3 mm, more preferably at least 0.5 mm, and even more preferably at least 0.7 mm, but preferably not more than 1.5 mm, more preferably not more than 1.2 mm, and even more preferably not more than 1.0 mm. If the cover is thicker than the above range, the ball may have an inadequate rebound on shots with a driver (W#1) or the spin rate may be too high, as a result of which an increased distance may not be achieved. Conversely, if the cover is thinner than the above range, the ball may have a poor scuff resistance and inadequate controllability even when played by a professional or other skilled golfer. Moreover, it is desirable that the cover be formed so as to be thinner than the intermediate layer. If the cover is thicker than the intermediate layer, the ball rebound may be lower and the ball may be too receptive to spin on full shots, as a result of which a sufficient distance may not be achieved.

The cover material, as with the above-described envelope layers and intermediate layer, is formed primarily of any of various types of resin materials, with the use of a thermoplastic resin or a thermoplastic elastomer being preferred. The use of a polyurethane is especially preferred because it enables the intended effects of the invention, i.e., both a good controllability and a good scuff resistance, to be achieved.

The polyurethane used as the cover material, while not subject to any particular limitation, is preferably a thermoplastic polyurethane, particularly from the standpoint of amenability to mass production.

It is preferable to use a specific thermoplastic polyurethane composition composed primarily of (A) a thermoplastic polyurethane and (B) a polyisocyanate compound. This resin blend is described below.

To fully exhibit the advantageous effects of the invention, a necessary and sufficient amount of unreacted isocyanate groups should be present in the cover resin material. Specifically, it is recommended that the total weight of above components A and B combined be at least 60%, and preferably at least 70%, of the overall weight of the cover. Components A and B are described in detail below.

The thermoplastic polyurethane serving as component A has a structure which includes soft segments made of a polymeric polyol that is a long-chain polyol (polymeric glycol), and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of cyclic ethers. The polyether polyol may be used singly or as a combination of two or more thereof. Of the above, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made with a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight computed based on the hydroxyl number measured in accordance with JIS K-1557.

Suitable chain extenders include those used in the prior art relating to thermoplastic polyurethanes. For example, low-molecular-weight compounds which have a molecular weight of 400 or less and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

The polyisocyanate compound is not subject to any particular limitation; preferred use may be made of one that is used in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornane diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component A to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of active hydrogen atoms to isocyanate groups in the above polyurethane-forming reaction can be controlled within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the thermoplastic polyurethane used as component A. Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

Illustrative examples of the thermoplastic polyurethane that may be used as component A include commercial products such as Pandex T8295, Pandex T8290 and Pandex T8260 (all available from DIC Bayer Polymer, Ltd.).

Next, concerning the polyisocyanate compound used as component B, it is essential that, in at least some portion thereof, all the isocyanate groups on the molecule remain in an unreacted state. That is, polyisocyanate compound in which all the isocyanate groups on the molecule remain in a completely free state should be present, and such a polyisocyanate compound may be present together with polyisocyanate compound in which only one end of the molecule is in a free state.

Various types of isocyanates may be employed without particular limitation as the polyisocyanate compound. Illustrative examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable in terms of the balance between the influence on processability of such effects as the rise in viscosity that accompanies the reaction with the thermoplastic polyurethane serving as component A and the physical properties of the resulting golf ball cover material.

In the practice of the invention, although not an essential constituent, a thermoplastic elastomer other than the above-described thermoplastic polyurethane may be included as component C together with components A and B. Including this component C in the above resin composition enables the fluidity of the resin composition to be further improved and enables improvements to be made in various properties required of golf ball cover materials, such as resilience and scuff resistance.

In addition to the above resin components, various optional additives may be included in the above-described resin materials for the envelope layer, the intermediate layer and the cover. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide).

Thickness Relationship between Envelope Layers, Intermediate Layer and Cover

In the present invention, the relationship between the thicknesses of the envelope layers, the intermediate layer and the cover be such that the combined thickness of the envelope layers and the intermediate layer is preferably at least 5.0 times the cover thickness. In particular the combined thickness of the envelope layers and the intermediate layer is more preferably at least 6.0 times, and most preferably at least 6.5 times, but preferably not more than 13 times, and even more preferably not more than 10 times, the thickness of the cover. If the combined thickness of the envelope layers and the intermediate layer is greater than the above range, the initial velocity of the ball when hit with a W#1 will be lower, as a result of which the ball will not travel as far. On the other hand, if the combined thickness of the envelope layers and the intermediate layer is smaller than the above range, the ball will have an increased spin when struck with a W#1, as a result of which the ball will not travel as far.

The combined thickness of the envelope layers and the intermediate layer, although not subject to any particular limitation, is preferably at least 3.0 mm, more preferably at least 4.0 mm, and even more preferably at least 5.0 mm, but preferably not more than 14.0 mm, more preferably not more than 11.0 mm, and even more preferably not more than 10 mm. Outside of this range in thickness, an adequate spin rate-lowering effect on shots with a W#1 may not be achieved, as a result of which the ball may not travel as far.

Hardness Relationship between Core Surface, Envelope Layer Surface, Intermediate Layer Surface and Cover Surface In the present invention, it is critical for the hardness relationship (JIS-C hardness) between the core surface, the envelope surface (surface of Sphere I), the intermediate layer surface (surface of Sphere II) and the cover surface (surface of Sphere III) to satisfy the following condition:

core surface hardness≦surface hardness of Sphere I<surface hardness of Sphere II>surface hardness of Sphere III.

That is, of the various layers making up the ball, by conferring the intermediate layer with the highest surface hardness, and by having the surface hardness of the envelope be lower than the surface hardness of the intermediate layer and higher than the surface hardness of the core, a spin rate-lowering effect can be achieved on shots with a driver, enabling the distance traveled by the ball to be increased.

The multi-piece solid golf ball of the invention can be manufactured using an ordinary process such as a known injection molding process to form on top of one another the respective layers described above: the core, the two or more envelope layers, the intermediate layer, and the cover. For example, a molded and vulcanized article composed primarily of a rubber material may be placed as the core within a particular injection-molding mold, following which the envelope layer-forming material and the intermediate layer-forming material may be injection-molded in this order over the core to give an intermediate spherical body. The spherical body may then be placed within another injection-molding mold and the cover material injection-molded over the spherical body to give a multi-piece golf ball. Alternatively, the cover may be formed as a layer over the intermediate spherical body by, for example, placing two half-cups, molded beforehand as hemispherical shells, around the intermediate spherical body so as to encase it, then molding under applied heat and pressure.

The inventive golf ball has a surface hardness which corresponds to the surface hardness of the sphere composed of the core encased by all the covering layers, i.e., in order, the envelope layers, the intermediate layer and the cover. The surface hardness of this sphere (referred to below as "Sphere III") is determined by the hardnesses of the materials used in each layer, the hardnesses of the respective layers, and the hardness below the surface of the ball. The surface hardness of the foregoing Sphere III, expressed as the JIS-C hardness, is preferably at least 73, more preferably at least 75, and even more preferably at least 77, but preferably not more than 100, more preferably not more than 98, and even more preferably not more than 93. If this hardness is lower than the above range, the ball may be too receptive to spin, as a result of which an increased distance may not be achieved. On the other hand, if the surface hardness of the ball is higher than the above range, the ball may not be receptive to spin on approach shots, which may result in a less than desirable controllability even for professionals and other skilled golfers.

It is desirable for the surface hardness of the inventive golf ball to be made softer than the surface hardness of the intermediate layer by an amount, expressed in JIS-C hardness units, of preferably at least 3, more preferably at least 5, and even more preferably at least 7, but preferably not more than 20, more preferably not more than 18, and even more preferably not more than 16. At a hardness difference smaller than this range, the ball may lack receptivity to spin on approach shots, resulting in a less than desirable controllability even for professional and other skilled golfers. At a hardness difference larger than the above range, the rebound may be inadequate or the ball may be too receptive to spin on full shots, as a result of which the desired distance may not be achieved.

Letting (P) be the deflection by the core when compressed under a final load of 1,275 N (130 kgf) from an initial load of 98 N (10 kgf) and letting (Q) be the deflection by the ball as a whole when compressed under a final load of 1,275 N (130 kgf) from an initial load of 98 N (10 kgf), it is desirable for the value (P)/(Q) to satisfy the condition $$1.7 \leqq (P)/(Q) \leqq 4.7.$$

That is, by setting the core deflection so as to be larger within a specific range than the deflection by the ball as a whole, the spin rate can be lowered and the distance increased, particularly on shots taken at high head speeds. If this value is too small, the spin rate on shots taken with a W#1 may increase, as a result of which the desired distance may not be achieved. On the other hand, if this value is too large, the initial velocity of the ball on shots taken with a W#1 may decrease, as a result of which the desired distance may not be achieved.

Numerous dimples may be formed on the surface of the cover. The dimples arranged on the cover surface, while not subject to any particular limitation, number preferably at least 280, more preferably at least 300, and even more preferably at least 320, but preferably not more than 360, more preferably not more than 350, and even more preferably not more than 340. If the number of dimples is higher than the above range, the ball will tend to have a low trajectory, which may shorten the distance of travel. On the other hand, if the number of dimples is too small, the ball will tend to have a high trajectory, as a result of which an increased distance may not be achieved.

Any one or combination of two or more dimple shapes, including circular shapes, various polygonal shapes, dewdrop shapes and oval shapes, may be suitably used. If circular dimples are used, the diameter of the dimples may be set to at least about 2.5 mm but not more than about 6.6 mm, and the depth may be set to at least 0.08 mm but not more than 0.30 mm.

To fully manifest the aerodynamic characteristics of the dimples, the dimple coverage on the spherical surface of the golf ball, which is the sum of the individual dimple surface areas, each defined by the border of the flat plane circumscribed by the edge of a dimple, expressed as a ratio (SR) with respect to the spherical surface area of the ball were it to be free of dimples, is preferably at least 60% but not more than 90%. Also, to optimize the trajectory of the ball, the value $V_0$ obtained by dividing the spatial volume of each dimple below the flat plane circumscribed by the edge of that dimple by the volume of a cylinder whose base is the flat plane and whose height is the maximum depth of the dimple from the base is preferably at least 0.35 but not more than 0.80. In addition, the VR value, which is the sum of the volumes of the individual dimples formed below the flat plane circumscribed by the edge of the respective dimple, as a percentage of the volume of the ball sphere were it to have no dimples thereon, is preferably at least 0.6% but not more than 1.0%. Outside of the above ranges for these values, the ball may assume a trajectory that is not conducive to achieving a good distance, as a result of which the ball may fail to travel a sufficient distance when played.

The golf ball of the invention, which can be manufactured so as to conform with the Rules of Golf for competitive play, may be produced to a ball diameter which is of a size that will not pass through a ring having an inside diameter of 42.672 mm, but is not more than 42.80 mm, and to a weight of generally from 45.0 to 45.93 g.

As shown above, by having the envelope composed of two or more layers, and by both optimizing the respective surface hardnesses of the sphere composed of the core encased by the envelope layers, the sphere composed of the core encased by the envelope layers/intermediate layer and the sphere composed of the core encased by the envelope layers/intermediate layer/cover and also optimizing the thicknesses of the respective layers, the inventive golf ball having a multi-layer construction is highly beneficial as a golf ball for professionals and other skilled golfers because it lowers the spin rate on full shots with a driver, providing increased distance, has a good controllability, particularly the ability to maintain a straight trajectory on full shots, and also has a good feel on impact and an excellent scuff resistance.

EXAMPLES

Examples of the invention and Comparative Examples are given below by way of illustration, and not by way of limitation.

Examples 1 to 3, Comparative Examples 1 to 6

[Formation of Core]

Rubber compositions were formulated as shown in Table 1, then molded and vulcanized under the vulcanization conditions in Table 1 to form cores.

TABLE 1

| | | Example | | | Comparative Example | | | | | |
|---|---|---|---|---|---|---|---|---|---|---|
| | | 1 | 2 | 3 | 1 | 2 | 3 | 4 | 5 | 6 |
| Rubber formulation | Polybutadiene | 100 | 100 | 100 | 100 | 100 | 100 | 100 | 100 | 100 |
| | Zinc acrylate | 6.8 | 15.0 | 20.5 | 6.8 | 6.8 | 6.8 | 6.8 | 6.8 | 15.0 |
| | Peroxide | 1.2 | 1.2 | 1.2 | 1.2 | 1.2 | 1.2 | 1.2 | 1.2 | 1.2 |
| | Antioxidant | 0.1 | 0.1 | 0.1 | 0.1 | 0.1 | 0.1 | 0.1 | 0.1 | 0.1 |
| | Zinc oxide | 93.4 | 92.2 | 91.5 | 93.4 | 93.4 | 98.9 | 62.5 | 37.1 | 92.2 |
| | Zinc salt of pentachlorothiophenol | 1.0 | 1.0 | 1.0 | 1.0 | 1.0 | 1.0 | 1.0 | 1.0 | 1.0 |
| | Zinc stearate | 5.0 | 5.0 | 5.0 | 5.0 | 5.0 | 5.0 | 5.0 | 5.0 | 5.0 |
| Vulcanization | Temperature (° C.) | 155 | 155 | 155 | 155 | 155 | 155 | 155 | 155 | 155 |
| | Time (min) | 20 | 15 | 15 | 16 | 16 | 16 | 16 | 16 | 16 |

Note:
Numbers in the table represent parts by weight.

Trade names for key materials appearing in the tables are given below.

Polybutadiene: Available from JSR Corporation under the trade name BR 730.

Peroxide: A mixture of 1,1-di(t-butylperoxy)cyclohexane and silica, produced by NOF Corporation under the trade name Perhexa C-40.

Antioxidant: 2,2'-Methylenebis(4-methyl-6-t-butylphenol), produced by Ouchi Shinko Chemical Industry Co., Ltd. under the trade name Nocrac NS-6.

Zinc stearate: Available from NOF Corporation under the trade name Zinc Stearate G.

[Formation of Envelope Layers, Intermediate Layer and Cover]

Figure 2:
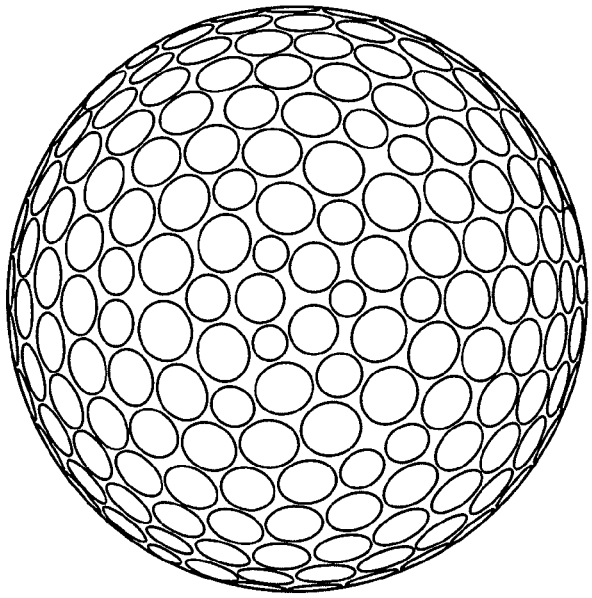
FIG. 2 is a top view of a golf ball showing the arrangement of dimples used in the examples of the invention.

Next, four covering layers—the envelope layers (composed of either one or two layers), intermediate layer and cover formulated from the various resin ingredients shown in Table 2—were injection-molded, thereby forming over the core, in order: one or two envelope layers, an intermediate layer and a cover. Finally, the dimples shown in Table 3 and FIG. 2, which were common to all the examples, were formed on the cover surface, thereby producing multi-piece solid golf balls.

TABLE 2

| | Formulation (pbw) | | | | | | | | | | |
|---|---|---|---|---|---|---|---|---|---|---|---|
| | A | B | C | D | E | F | G | H | I | J | K |
| HPF 1000 | 100 | | | | | | | | | | |
| HPF 2000 | | | | | | | | | | 100 | |
| AD 1040 | | 100 | | | | | | | | | |
| AD 1035 | | | | | | | | | | | 100 |
| Himilan 1707 | | | | | 100 | | | | | | |
| Himilan 1605 | | | 50 | | | | 100 | | 68.75 | | |
| Himilan 1557 | | | 15 | | | | | | | | |
| Himilan 1706 | | | 35 | | | | | | | | |
| Dynaron 6100P | | | | | | | | | 31.25 | | |
| Hytrel 3046 | | | | | | 100 | | | | | |
| Hytrel 4001 | | | | 15 | | | | | | | |
| Behenic acid | | | | | | | | | 18 | | |
| Calcium hydroxide | | | | | | | | | 2.3 | | |
| Calcium stearate | | | | | | | | | 0.15 | | |
| Zinc stearate | | | | | | | | | 0.15 | | |
| Trimethylolpropane | | | 1.1 | | | | | | | | |
| Polytail H | | | | | | | | | 2 | | |
| Pandex T-8290 | | | | 100 | | | | | | | |
| Pandex T-8260 | | | | | | | | 100 | | | |
| Titanium oxide | | | | 3.5 | | | | 3.8 | | | |
| Polyethylene wax | | | | 1.5 | | | | 1.4 | | | |
| Isocyanate compound | | | | 9 | | | | | | | |
| Isocyanate mixture | | | | | | | | 18 | | | |

Trade names for key materials appearing in the table are given below.

HPF 1000 (trade name): A terpolymer produced by E.I. DuPont de Nemours & Co. Composed of about 75 to 76 wt % ethylene, about 8.5 wt % acrylic acid and about 15.5 to 16.5 wt % n-butyl acrylate. All (100%) of the acid groups are neutralized with magnesium ions.

HPF 2000 (trade name): Produced by E.I. DuPont de Nemours & Co. All (100%) of the acid groups are neutralized with magnesium ions.

AD 1040: A HPF resin produced by E.I. DuPont de Nemours & Co.

AD 1035: A HPF resin produced by E.I. DuPont de Nemours & Co.

Himilan: Ionomer resins produced by DuPont-Mitsui Polychemicals Co., Ltd.

Dynaron 6100P: A hydrogenated polymer produced by JSR Corporation.

Hytrel: Polyester elastomers produced by DuPont-Toray Co., Ltd.

Behenic acid: NAA222-S (beads), produced by NOF Corporation.

Calcium hydroxide: CLS-B, produced by Shiraishi Kogyo.

Polytail H: A low-molecular-weight polyolefin polyol produced by Mitsubishi Chemical Corporation.

Pandex T-8260, T-8290: MDI-PTMG type thermoplastic polyurethanes produced by DIC Bayer Polymer.

Polyethylene wax: Produced by Sanyo Chemical Industries, Ltd. under the trade name Sanwax 161P.

Isocyanate compound: 4,4'-Diphenylmethane diisocyanate. The isocyanate compound was mixed with Pandex at the time of injection molding.

Isocyanate mixture: An isocyanate master batch produced by Dainichi Seika Colour & Chemicals Mfg. Co., Ltd. under the trade name Crossnate EM30. Contains 30% of 4,4'-diphenylmethane diisocyanate (measured concentration of amine reverse-titrated isocyanate according to JIS-K1556, 5 to 10%). A polyester elastomer was used as the master batch base resin.

TABLE 3

| No. | Number of dimples | Diameter (mm) | Depth (mm) | $V_0$ | SR | VR |
|---|---|---|---|---|---|---|
| 1 | 12 | 4.6 | 0.15 | 0.47 | 0.81 | 0.783 |
| 2 | 234 | 4.4 | 0.15 | 0.47 | | |
| 3 | 60 | 3.8 | 0.14 | 0.47 | | |
| 4 | 6 | 3.5 | 0.13 | 0.46 | | |
| 5 | 6 | 3.4 | 0.13 | 0.46 | | |
| 6 | 12 | 2.6 | 0.10 | 0.46 | | |
| Total | 330 | | | | | |

[Dimple Definitions]

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the border of the flat plane circumscribed by the edge of a dimple, as a percentage of surface area of ball sphere were it to have no dimples thereon.

VR: Sum of volumes of individual dimples formed below flat plane circumscribed by the edge of the dimple, as a percentage of volume of ball sphere were it to have no dimples thereon.

The golf balls obtained in Examples 1 to 3 of the invention and in Comparative Examples 1 to 6 were tested and evaluated according to the criteria described below with regard to the following: deflection and other physical properties of each layer and the ball, flight performance (on shots with a driver and shots with an iron), spin on approach shots (controllability), and scuff resistance. The results are shown in Tables 4 and 5. All measurements were carried out in a 23° C. atmosphere.

(1) Core Deflection

The core was placed on a hard plate, and the deflection (mm) by the core when compressed under a final load of 1,275 N (130 kgf) from an initial load of 98 N (10 kgf) was measured.

(2) Core Surface Hardness

The durometer indenter was set substantially perpendicular to the spherical surface of the core, and JIS-C hardness measurements (in accordance with JIS-K6301) were taken at two randomly selected points on the core surface. The average of the two measurements was used as the core surface hardness.

(3) Hardnesses of First and Second Envelope Layer Materials

The resin materials for the envelope layers were formed into sheets having a thickness of about 2 mm, and the hardnesses of the materials were measured with a type D durometer in accordance with ASTM D-2240.

(4) Surface Hardness of Sphere I (Envelope Layers-Covered Sphere)

The durometer indenter was set substantially perpendicular to the spherical surface of the envelope layer, and the JIS-C hardness was measured.

(5) Surface Hardness of Sphere II (Intermediate Layer-Covered Sphere)

The durometer indenter was set substantially perpendicular to the spherical surface of the intermediate layer, and the JIS-C hardness was measured.

(6) Hardness of Intermediate Layer Material

The same method of measurement was used as in (3) above.

(7) Surface Hardness of Sphere III (Cover Covered Sphere)

The durometer indenter was set substantially perpendicular to the spherical surface of the cover and the JIS-C hardness was measured.

(8) Hardness of Cover Material

The same method of measurement was used as in (3) above.

(9) Ball Deflection

The ball was placed on a hard plate, and the deflection (mm) by the ball when compressed under a final load of 1,275 N (130 kgf) from an initial load of 98 N (10 kgf) was measured.

(10) Flight Performance on Shots with Driver

The carry and total distance of the ball when hit at a head speed (HS) of 53 m/s with a driver (TourStage X-Drive 405 (2005 model), manufactured by Bridgestone Sports Co., Ltd.; loft angle, 8.5°) mounted on a swing robot were measured. The results were rated according to the criteria shown below. The spin rate was the value measured for the ball immediately following impact, using an apparatus for measuring initial conditions.

Good: Total distance was 270 m or more

NG: Total distance was less than 270 m

(11) Flight Performance on Shots with Iron

The carry and total distance of the ball when hit at a head speed (HS) of 45 m/s with an iron (abbreviated below as "I#6"; TourStage X-Blade CB (2003 model), manufactured by Bridgestone Sports Co., Ltd.) mounted on a swing robot were measured. The results were rated according to the criteria shown below. The spin rate was measured in the same way as described above.

Good: Total distance was 182 m or more

NG: Total distance was less than 182 m

(12) Spin Rate on Approach Shots

The spin rate of a ball hit at a head speed of 24 m/s with a sand wedge (abbreviated below as "SW"; J's Classical Edition, manufactured by Bridgestone Sports Co., Ltd.) was measured. The results were rated according to the criteria shown below. The spin rate was measured by the same method as that used above when measuring distance.

Good: Spin rate of 6,000 rpm or more

NG: Spin rate of less than 6,000 rpm

(13) Scuff Resistance

A non-plated pitching sand wedge was set in a swing robot, and the ball was hit once at a head speed of 33 m/s, following which the surface state of the ball was visually examined and rated as follows.

Good: Can be used again

NG: Cannot be used again

TABLE 4

| | | Example | | | Comparative Example | | | | | |
|---|---|---|---|---|---|---|---|---|---|---|
| | | 1 | 2 | 3 | 1 | 2 | 3 | 4 | 5 | 6 |
| Core | Diameter (mm) | 26.8 | 27 | 26.9 | 26.9 | 26.9 | 30.3 | 35.3 | 27 | 36.7 |
| | Weight (g) | 15.5 | 15.9 | 15.7 | 15.7 | 16 | 19.9 | 28 | 13.6 | 30.6 |
| | Deflection (mm) | 8.3 | 5.7 | 4.6 | 4.6 | 4.6 | 4.6 | 4.6 | 5.7 | 4.6 |
| | Center hardness (JIS-C) | 43 | 57 | 63 | 63 | 63 | 63 | 63 | 58 | 63 |
| | Surface hardness (JIS-C) | 51 | 69 | 78 | 78 | 78 | 78 | 78 | 69 | 78 |
| | Surface hardness difference | 8 | 12 | 14 | 15 | 15 | 15 | 15 | 11 | 15 |
| First envelope layer | Type | A | A | A | | | | | | |
| | Thickness (mm) | 2.8 | 2.7 | 2.8 | | | | | | |
| | Specific gravity | 0.95 | 0.95 | 0.95 | | | | | | |
| | Material hardness (Shore D) | 49 | 49 | 49 | | | | | | |
| Sphere | Diameter (mm) | 32.5 | 32.5 | 32.5 | | | | | | |
| | Surface hardness (JIS-C) | 89 | 89 | 90 | | | | | | |
| Second envelope layer | Type | B | B | B | A | E | A | A | F | — |
| | Thickness (mm) | 2.8 | 2.9 | 2.9 | 5.7 | 5.7 | 3.5 | 1.5 | 5.6 | — |
| | Specific gravity | 0.95 | 0.95 | 0.95 | 0.95 | 0.94 | 0.95 | 0.95 | 1.07 | — |
| | Material hardness | 56 | 56 | 56 | 49 | 62 | 49 | 49 | 30 | — |

TABLE 4-continued

| | | Example | | | Comparative Example | | | | | |
|---|---|---|---|---|---|---|---|---|---|---|
| | | 1 | 2 | 3 | 1 | 2 | 3 | 4 | 5 | 6 |
| | (Shore D) | | | | | | | | | |
| Sphere I | Diameter (mm) | 38.2 | 38.2 | 38.2 | 38.3 | 38.3 | 38.3 | 38.3 | 38.3 | — |
| | Surface hardness (JIS-C) | 93 | 93 | 93 | 90 | 97 | 90 | 90 | 58 | — |
| Intermediate layer | Type | C | C | C | I | G | C | C | C | C |
| | Thickness (mm) | 1.2 | 1.2 | 1.2 | 1.2 | 1.2 | 1 | 1.2 | 1.2 | 2 |
| | Specific gravity | 0.95 | 0.95 | 0.95 | 0.95 | 0.95 | 0.95 | 0.95 | 0.95 | 0.95 |
| | Material hardness (Shore D) | 62 | 62 | 62 | 62 | 61 | 62 | 62 | 62 | 62 |
| Sphere II | Diameter (mm) | 40.7 | 40.7 | 40.7 | 40.7 | 40.7 | 40.7 | 40.7 | 40.7 | 40.7 |
| | Surface hardness (JIS-C) | 97 | 97 | 97 | 97 | 96 | 97 | 97 | 97 | 97 |
| Cover | Type | D | D | D | H | D | D | D | D | D |
| | Thickness (mm) | 1.0 | 1.0 | 1.0 | 1.0 | 1.0 | 1.0 | 1.0 | 1.0 | 1.0 |
| | Specific gravity | 1.15 | 1.15 | 1.15 | 1.15 | 1.15 | 1.15 | 1.15 | 1.15 | 1.15 |
| | Material hardness (Shore D) | 49 | 49 | 49 | 58 | 49 | 49 | 49 | 49 | 49 |
| Sphere III (Ball) | Diameter (mm) | 42.7 | 42.7 | 42.7 | 42.7 | 42.7 | 42.7 | 42.7 | 42.7 | 42.7 |
| | Deflection (mm) | 2.5 | 2.4 | 2.2 | 2.6 | 1.7 | 2.3 | 3.3 | 3.7 | 3.5 |
| | Surface hardness (JIS-C) | 86 | 86 | 86 | 96 | 86 | 83 | 86 | 86 | 86 |
| (P)/(Q) | | 3.29 | 2.41 | 2.08 | 1.8 | 2.7 | 2.04 | 1.39 | 1.55 | 1.31 |
| Rating | | Good | Good | Good | Good | Good | Good | NG | NG | NG |
| Combined thickness of envelope layers and intermediate layer | | 6.92 | 6.83 | 6.87 | 6.89 | 6.89 | 4.5 | 2.69 | 6.84 | 2 |
| Cover thickness × 5.0 | | 5.0 | 5.0 | 5.0 | 5.0 | 5.0 | 8.5 | 5.0 | 5.0 | 5.0 |
| Rating | | Good | Good | Good | Good | Good | NG | NG | Good | NG |

Note:
The above (P)/(Q) value is the (core deflection)/(ball deflection).

TABLE 5

| | | | Example | | | Comparative Example | | | | | |
|---|---|---|---|---|---|---|---|---|---|---|---|
| | | | 1 | 2 | 3 | 1 | 2 | 3 | 4 | 5 | 6 |
| Flight | W#1 (HS, 53 m/s) | Spin rate (rpm) | 2733 | 2744 | 2923 | 2688 | 2970 | 2958 | 3013 | 2927 | 2975 |
| | | Carry (m) | 248 | 252 | 255 | 249 | 251 | 251 | 252 | 247 | 247 |
| | | Total distance (m) | 274.8 | 276.1 | 277.6 | 272.6 | 268.8 | 266.8 | 267.7 | 268.5 | 269.0 |
| | | Rating | Good | Good | Good | Good | NG | NG | NG | NG | NG |
| | I#6 (HS, 45 m/s) | Spin rate (rpm) | 5717 | 5716 | 6149 | 5745 | 5946 | 6170 | 5975 | 5715 | 5872 |
| | | Carry (m) | 171 | 171 | 171 | 171 | 168 | 166 | 169 | 171 | 170 |
| | | Total distance (m) | 186 | 188 | 185 | 186 | 181 | 180 | 181 | 188 | 184 |
| | | Rating | Good | Good | Good | Good | NG | NG | NG | Good | Good |
| | SW (HS, 24 m/s) | Spin rate (rpm) | 6333 | 6412 | 6377 | 5796 | 6408 | 6442 | 6318 | 6301 | 6232 |
| | | Rating | Good | Good | Good | NG | Good | Good | Good | Good | Good |
| | Scuff resistance | | Good | Good | Good | NG | Good | Good | Good | Good | Good |

As is apparent from the results in Table 5, the golf ball in Comparative Example 1 was a four-piece ball having a hard cover and a single envelope layer; the ball lacked sufficient spin on approach shots and also had a poor scuff resistance. The golf ball in Comparative Example 2 was a four-piece golf ball having a single envelope layer that was hard; the spin rate-lowering effect was inadequate and the initial velocity of the ball when hit was low, resulting in a poor distance. The golf ball in Comparative Example 3 was a four-piece golf ball having a hard cover and a single envelope layer; the spin rate-lowering effect was inadequate, resulting in a poor distance. The golf ball in Comparative Example 4 was a four-piece golf ball having a single envelope layer that was thin; the spin rate-lowering effect was inadequate, resulting in a poor distance. The golf ball in Comparative Example 5 was a four-piece golf ball having a single envelope layer that was soft; the spin rate-lowering effect was inadequate and the initial velocity of the ball when hit was low, resulting in a poor distance. The golf ball in Comparative Example 6 was a three-piece golf ball lacking an envelope layer; the spin rate-lowering effect was inadequate, resulting in a poor distance.

Example 4

Production of Multi-Piece Solid Golf Ball Having Four Envelope Layers

A multi-piece solid golf ball composed of seven layers was manufactured by encasing a core within four envelope layers, followed in turn by a single intermediate layer, then a single cover layer.

Aside from setting the amount of zinc acrylate to 5.0 parts by weight and the amount of zinc oxide to 261.0 parts by weight, the core was produced using the same formulation and under the same vulcanizing conditions as in Example 1. The physical properties of the core are shown below in Table 6. As in the above examples, the four envelope layers, intermediate layer and cover were successively placed over the core, thereby producing a multi-piece solid golf ball having seven layers. Measurements of physical properties and evaluations of performance characteristics were carried out in the same way as in the above examples.

TABLE 6

| | | |
|---|---|---|
| Core | Diameter (mm) | 22.0 |
| | Weight (g) | 9.9 |
| | Deflection (mm) | 6.5 |
| | Center hardness (JIS-C) | 56 |
| | Surface hardness (JIS-C) | 63 |
| | Surface hardness difference | 7 |
| First envelope layer | Type | K |
| | Thickness (mm) | 2.0 |
| | Specific gravity | 0.95 |
| | Material hardness (Shore D) | 38 |
| Sphere | Diameter (mm) | 26.0 |
| | Surface hardness (JIS-C) | 70 |
| Second envelope layer | Type | J |
| | Thickness (mm) | 1.7 |
| | Specific gravity | 0.95 |
| | Material hardness (Shore D) | 45 |
| Sphere | Diameter (mm) | 29.4 |
| | Surface hardness (JIS-C) | 79 |
| Third envelope layer | Type | A |
| | Thickness (mm) | 1.7 |
| | Specific gravity | 0.95 |
| | Material hardness (Shore D) | 49 |
| Sphere | Diameter (mm) | 32.8 |
| | Surface hardness (JIS-C) | 90 |
| Fourth envelope layer | Type | B |
| | Thickness (mm) | 2.7 |
| | Specific gravity | 0.95 |
| | Material hardness (Shore D) | 56 |
| Sphere I | Diameter (mm) | 38.2 |
| | Surface hardness (JIS-C) | 93 |
| Intermediate layer | Type | C |
| | Thickness (mm) | 1.2 |
| | Specific gravity | 0.95 |
| | Material hardness (Shore D) | 62 |
| Sphere II | Diameter (mm) | 40.7 |
| | Surface hardness (JIS-C) | 97 |
| Cover | Type | D |
| | Thickness (mm) | 1.0 |
| | Specific gravity | 1.15 |
| | Material hardness (Shore D) | 49 |
| Sphere III (Ball) | Diameter (mm) | 42.7 |
| | Deflection (mm) | 2.2 |
| | Surface hardness (JIS-C) | 86 |
| (P)/(Q) | | 2.91 |
| Rating | | Good |
| Combined thickness of envelope layers and intermediate layer | | 9.34 |
| Cover thickness × 5.0 | | 5.0 |
| Rating | | Good |

TABLE 7

| | | | |
|---|---|---|---|
| Flight | W#1 | Spin rate (rpm) | 2898 |
| | (HS, 53 m/s) | Carry (m) | 253 |
| | | Total distance (m) | 275.8 |
| | | Rating | Good |
| | I#6 | Spin rate (rpm) | 6201 |
| | (HS, 45 m/s) | Carry (m) | 169 |
| | | Total distance (m) | 184 |
| | | Rating | Good |
| | SW | Spin rate (rpm) | 6175 |
| | (HS, 24 m/s) | Rating | Good |
| Scuff resistance | | | Good |

The invention claimed is:

1. A multi-piece solid golf ball comprising a core, an envelope encasing the core, an intermediate layer encasing the envelope, and a cover which encases the intermediate layer and has formed on a surface thereof a plurality of dimples, wherein the surface hardness of the core has a JIS-C hardness value of 40 to 95, the center hardness of the core has a JIS-C hardness value of 30 to 72, and the hardness difference therebetween is from 4 to 20; the envelope is composed of at least two layers; the core is formed primarily of a rubber material; the envelope, intermediate layer and cover are each formed primarily of the same or different resin materials; and the core, a Sphere I composed of the core encased by the envelope layers, a Sphere II composed of the core encased by the envelope layers and the intermediate layer, and a Sphere III composed of the core encased by the envelope layers, the intermediate layer and the cover have JIS-C surface hardness relationships therebetween which satisfy the following condition:

core surface hardness≦Sphere I surface hardness<Sphere II surface hardness>Sphere III surface hardness.

2. The multi-piece solid golf ball of claim 1, wherein each envelope layer has a thickness of at least 1 mm but not more than 5 mm.

3. The multi-piece solid golf ball of claim 1, wherein the core has a deflection (P) when compressed under a final load of 1,275 N (130 kgf) from an initial load of 98 N (10 kgf) and the ball as a whole has a deflection (Q) when compressed under a final load of 1,275 N (130 kgf) from an initial load of 98 N (10 kgf) which satisfy the condition $$1.7 \leqq (P)/(Q) \leqq 4.7.$$

4. The multi-piece solid golf ball of claim 1, wherein the resin material of at least one layer from among the envelope layers and the intermediate layer comprises, in admixture, an ionomer resin component of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50.

5. The multi-piece solid golf ball of claim 1, wherein the resin material of at least one layer from among the envelope layers and the intermediate layer is a mixture comprising:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) 5 to 80 parts by weight of a fatty acid and/or fatty acid derivative having a molecular weight of 228 to 1500; and (d) 0.1 to 17 parts by weight of a basic inorganic metal compound capable of neutralizing un-neutralized acid groups in the base resin and component (c).

6. The multi-piece solid golf ball of claim 1, wherein the cover is formed by injection molding a single resin blend composed primarily of (A) a thermoplastic polyurethane and (B) a polyisocyanate compound, which resin blend contains a polyisocyanate compound in at least some portion of which all the isocyanate groups remain in an unreacted state.

7. The multi-piece solid golf ball of claim 1, wherein the envelope layers and the intermediate layer have a combined thickness which is 6.0 to 13 times thicker than the cover.

8. The multi-piece solid golf ball of claim 1, wherein the combined thickness of the envelope layers and the intermediate layer is 3.0 to 14.0 mm.

9. The multi-piece solid golf ball of claim 1, wherein an organosulfur compound is included in the rubber material constituting the core by an amount of 0.05 to 5 parts by weight per 100 parts by weight of the base rubber.

10. The multi-piece solid golf ball of claim 1, wherein each of the envelope layers has a material hardness of 20 to 70 expressed as the Durometer D hardness, and the individual envelope layers are arranged so that successive envelope layers in the outward direction are of the same or greater hardness, within the above-indicated hardness range.

11. The multi-piece solid golf ball of claim 10, wherein the envelope layer directly in contact with the intermediate layer has a material hardness expressed as the Durometer D hardness of 56 to 70.

12. The multi-piece solid golf ball of claim 1, wherein the surface of the Sphere I has a JIS-C hardness of 47 to 105.

13. The multi-piece solid golf ball of claim 1, wherein the surface of the envelope is lower than the surface of the intermediate layer by a difference of 1 to 20 in JIS-C hardness units.

14. The multi-piece solid golf ball of claim 1, wherein the intermediate layer has a material hardness of 50 to 70 expressed as the Durometer D hardness.

15. The multi-piece solid golf ball of claim 1, wherein the Sphere II surface hardness is higher than Sphere III surface hardness by a difference of 3 to 20 in JIS-C hardness units.

16. The multi-piece solid golf ball of claim 1, wherein the number of the dimples is 280 to 360, the dimple coverage on the spherical surface of the golf ball expressed as a ratio (SR) is 60 to 90%, the value $V_0$ obtained by dividing the spatial volume of each dimple below the flat plane circumscribed by the edge of that dimple by the volume of a cylinder whose base is the flat plane and whose height is the maximum depth of the dimple from the base is 0.35 to 0.80, and the VR value, which is the sum of the volumes of the individual dimples formed below the flat plane circumscribed by the edge of the respective dimple, as a percentage of the volume of the ball sphere were it to have no dimples thereon, is 0.6 to 1.0%.

17. The multi-piece solid golf ball of claim 1, wherein the deflection of the core when compressed under a final load of 1,275 N (130 kgf) from an initial load of 98 N (10 kgf) is from 5.7 to 10.0 mm.

18. The multi-piece solid golf ball of claim 1, wherein the polybutadiene synthesized with a rare-earth catalyst or a Group VIII metal compound catalyst is used as the base rubber of the rubber material.

* * * * *